US006025770A

United States Patent [19]

Okamoto et al.

[11] Patent Number: 6,025,770

[45] Date of Patent: Feb. 15, 2000

[54] IGNITION COIL WITH COUNTER MAGNETIC FIELD

[75] Inventors: Noriya Okamoto; Shinichi Amano, both of Yokkaichi, Japan

[73] Assignee: Sumitomo Wiring Systems, Ltd., Japan

[21] Appl. No.: 09/157,303

[22] Filed: Sep. 18, 1998

[30] Foreign Application Priority Data

Sep. 18, 1997 [JP] Japan ..... 9-253175

[51] Int. Cl.[7] ..... H01F 27/08

[52] U.S. Cl. ..... 336/83; 336/110; 336/212; 336/234

[58] Field of Search ..... 336/83, 110, 212, 336/234; 123/634, 635

[56] References Cited

U.S. PATENT DOCUMENTS 2,962,699 11/1960 Stratton ..... 336/212
5,101,803 4/1992 Nakamura et al. ..... 336/110
5,146,906 9/1992 Agatsuma .

FOREIGN PATENT DOCUMENTS 0431322 12/1991 European Pat. Off. .
8213259 8/1996 Japan .

*Primary Examiner*—Thomas J. Kozma
*Attorney, Agent, or Firm*—Jordan B. Bierman; Bierman, Muserlian and Lucas

[57] ABSTRACT

An ignition coil having a transformer surrounding a cylindrical magnetic core. The transformer has a primary coil, to which a DC potential is applied in bursts and which generates a primary magnetic field, and a secondary coil, which retrieves induced electromotive force. An outer cylinder, surrounding the transformer, is also provided. At at least one end of the ignition coil at least one toroidal magnet is located. The inside and outside perimeters of the toroidal magnets have polarities which are opposite to each other. When a plurality of magnets is provided, they are nested inside one another between the magnetic core and the outer cylinder. The direction of the reverse biasing magnetic field generated by the magnet(s) is opposite to that of primary magnetic field generated by the primary coil. The foregoing construction provides a compact ignition coil which is efficient in operation and is capable of making effective use of the induced electromotive force generated.

19 Claims, 8 Drawing Sheets

IGNITION COIL WITH COUNTER MAGNETIC FIELD

This Application claims the benefit of the priority of Japanese 9-253175, filed Sep. 18, 1997.

The present Invention is directed to an ignition coil particularly useful in internal combustion engines for automotive vehicles. More specifically, the Invention relates to an ignition coil of the independent ignition type which is inserted into a plug hole of an engine.

BACKGROUND OF THE INVENTION

Japanese OPI 8-213259 describes the conventional ignition coil as used in internal combustion engines. As shown in FIGS. 11 and 12, an ignition coil having an open magnetic path comprises transformer 7 composed of primary coil 3 surrounding secondary coil 5 which, in turn, surrounds magnetic core 1. To prevent magnetic leakage, outer cylinder 9 is disposed around transformer 7. This structure is relatively compact, having a small diameter.

Plate-shaped magnetic member 11 is at one or both ends of magnetic core 1 and provides reverse bias for magnetic field B1 which, in turn, is generated by primary coil 3. The residual magnetic flux density in magnetic core 1, generated by primary coil 3, is decreased by the coercive force from magnetic member 11. When a direct current voltage is applied in bursts to primary coil 3, the changes in flux density in magnetic core 1 are increased, thus providing more efficient energy retrieval at secondary coil 5.

To supplement magnetic core 1, outer cylinder 9 is provided. However, because the magnetic path between magnetic core 1 and outer cylinder 9 is interrupted, the actual magnetic leakage is comparatively high. This impairs the use of magnetic field B1 and makes the retrieval of energy less efficient.

A large proportion of magnetic field B1, extending from the end of magnetic core 1 to the end of outer cylinder 9, is along a direction perpendicular to the axis of the magnetic core. Magnetic field A1, generated by magnet member 11, is formed along the thickness of the magnet member, i.e. axially of magnetic core 1. As a result, magnetic field B1 is not weakened by magnet member 11; on the contrary, magnetic field B1, formed between magnetic core 1 and outer cylinder 9, avoids magnet member 11. Therefore, reverse bias magnetic field A1 cannot efficiently counter magnetic field B1. This additionally prevents the secondary output from increasing. FIGS. 11 and 12 show composite magnetic field C1 formed by magnetic field B1 and magnetic field A1. As can particularly be seen in FIG. 12, composite magnetic field C1 avoids magnetic member 11 and is thus not weakened.

Japanese OPI 3-154311 discloses an ignition coil with a ring-shaped permanent magnet as the reverse-biasing magnet member. However, this patent makes no mention of the direction of the magnetic field generated by the magnet member, and the manner of application of the reverse-biasing magnetic field is unclear. If the magnet member generates a field along the thickness axis thereof, as is the case in the conventional technology shown in FIGS. 11 and 12, then a suitable reverse-biasing magnetic field cannot be achieved for the same reasons as set forth above. On the other hand, if the magnetic member generates a field in the radial direction, then the volume of the permanent magnet will be insufficient, since it must be located within the ring-shaped core. For this reason, a reverse-biasing magnetic field of adequate strength cannot be obtained in this manner.

SUMMARY OF THE INVENTION

It is, therefore, an object of the present Invention to provide an ignition coil that can use the magnetic field generated by the primary coil in an efficient manner, and can apply an appropriate and adequate magnetic field which is biased opposite to the field generated by the primary coil. When this is accomplished, more efficient energy retrieval can be obtained, while permitting a more compact design with a smaller diameter.

In practicing the present Invention, there is provided an ignition coil having a transformer which surrounds a cylindrical magnetic core. The transformer includes the usual primary coil, to which a DC potential is applied in bursts and which generates a primary magnetic field, and a secondary coil, which retrieves the induced electromotive force. An outer cylinder surrounds the transformer.

In one embodiment of the present Invention, there is provided a plurality of toroidal magnets wherein the inside perimeters and outside perimeters have polarities opposite to each other. Successive toroidal magnets are reduced in size so that they can nest inside one another. The nested toroidal magnets are located adjacent at least one end of the transformer along the axis of the magnetic core. They are between the magnetic core and the outer cylinder and thus apply a counter magnetic field thereto. This counter magnetic field is opposite to the direction of the primary magnetic field.

In a preferable form of this embodiment, the magnetic core is of a silicon steel alloy. However, since this alloy is difficult to machine, the magnetic core is advantageously constructed of a plurality of laminated plates, extending along the axis of the magnetic core. To avoid the machining problem, the individual plates are stamped into the desired predetermined shapes prior to lamination.

It is also desirable that the transformer abut the exterior of the magnetic core. For best results, the core should extend axially beyond the end of the outer cylinder remote from the toroidal magnets.

In a second embodiment of the present Invention, there is provided a flange which projects outwardly beyond the outer perimeter of the magnetic core. The flange is located adjacent at least one end of the magnetic core and a toroidal magnet is placed between the outer perimeter of the magnetic core and the inner perimeter of the outer cylinder. The inside perimeter of the toroidal magnet has a magnetic field with a polarity opposite that of its outside perimeter.

In this embodiment, the magnetic core comprises the flange and a magnetic core unit, the latter extending axially of the ignition coil from the flange towards the end of the ignition coil remote therefrom. It is desirable that both the magnetic core unit and the flange be made of silicon steel alloy. As in the first embodiment, the machining problem with respect to the magnetic core unit is overcome by stamping out a plurality of plates which are then laminated so as to abut one another. They extend axially of the magnetic core.

The flange is also usefully made of silicon steel alloy and, in this case, stacked plates are stamped out and placed in abutting relationship, one on top of another. Their diameters are greater than that of the magnetic core unit.

In a modification of the second embodiment, the flange comprises a toroidal magnetic element having an inner diameter which is fitted to the outside diameter of the magnetic core. It is particularly desirable that both the toroidal magnetic element and the magnetic core unit be of a silicon steel alloy. The magnetic core unit is made of laminated plates in the same manner as previously stated. However, in this modification, the toroidal magnetic element comprises a plurality of toroidal stacked rings. These are made by stamping and then layered together.

In this embodiment, at least one radial slit in the stacked layers making up the flange is provided. Preferably, a plurality of such slits is made in the magnetic member. When changes in the primary magnetic field generated by the primary coil occur, the accompanying eddy current generated around the axis of the magnetic core in the magnetic member can be reduced. As a result, energy loss is also reduced, and the secondary energy can be sufficiently retrieved.

In a still further modification of the device, the flange comprises a plurality of laminated layers abutting each other. These laminated layers extend axially of the magnetic core.

BRIEF DESCRIPTION OF THE DRAWINGS

In the accompanying drawings, constituting a part hereof, and in which like reference characters indicate like parts.

DETAILED DESCRIPTION OF THE INVENTION

Figure 1:
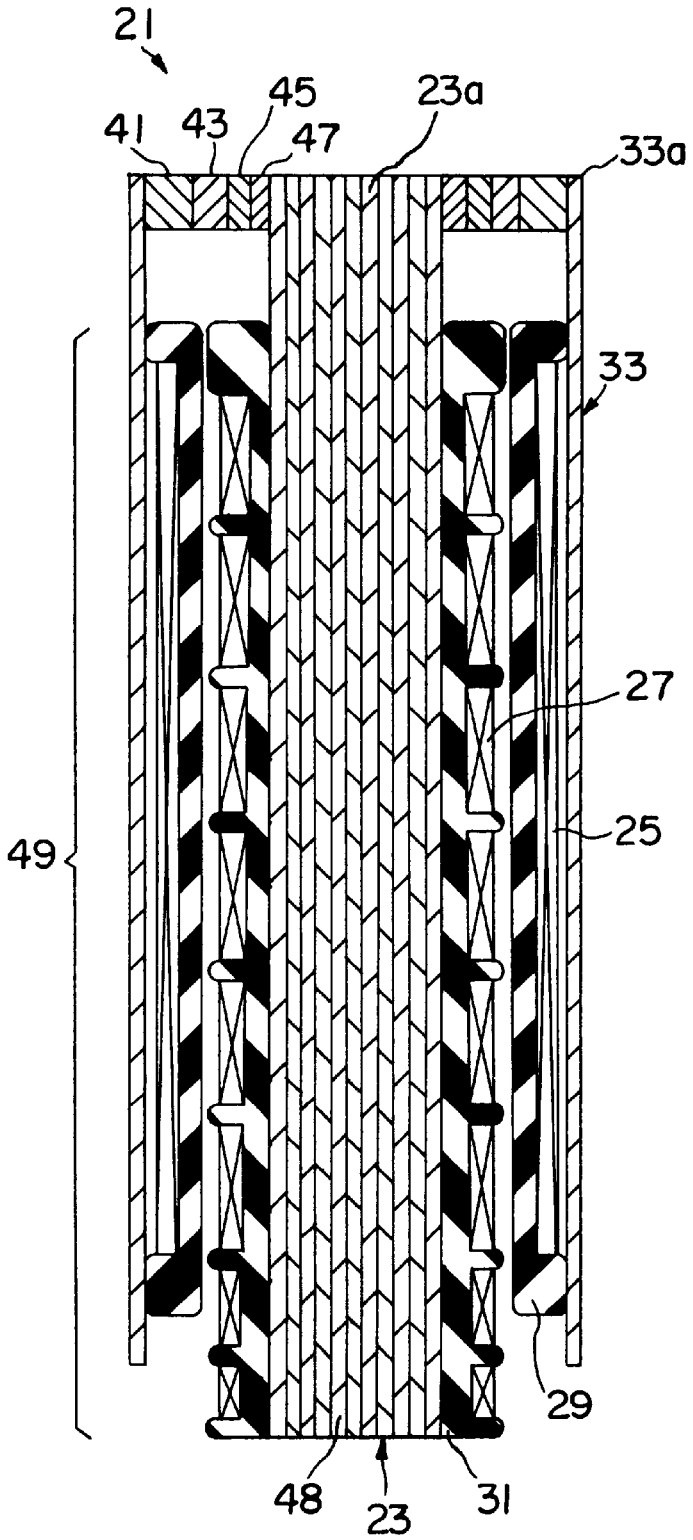
FIG. 1 is a cross-section of an ignition coil according to the first embodiment of the present Invention.

Referring to FIGS. 1 to 6, ignition coil 21 comprises transformer 49, magnetic core 23, outer cylinder 33, and toroidal magnets 41, 43, 45, and 47. Transformer 49 is made up of primary coil 25 on first bobbin 29 and secondary coil 27 on second bobbin 31. Outer cylinder 33 surrounds transformer 49 and toroidal magnets 41, 43, 45, and 47 are located between upper end 23*a* of magnetic core 23 and upper end 33*a* of outer cylinder 33. DC potential is applied in bursts to primary coil 25 and secondary coil 27 is used to retrieve the induced electromotive force.

Magnetic core 23 preferably is of a silicon steel alloy. However, since this alloy is difficult to machine or shape, magnetic core 23 is made up of a plurality of thin silicon steel plates 48. To avoid the machining problem, plates 48 are formed by stamping in a suitable predetermined shape. Thereafter, they are laminated as shown in the Figures.

Figure 2:
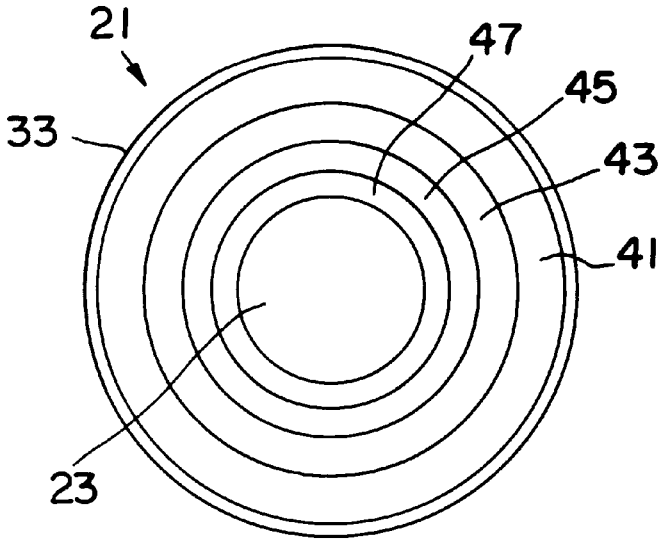
FIG. 2 is a plan view of the ignition coil of FIG. 1.
Figure 3:
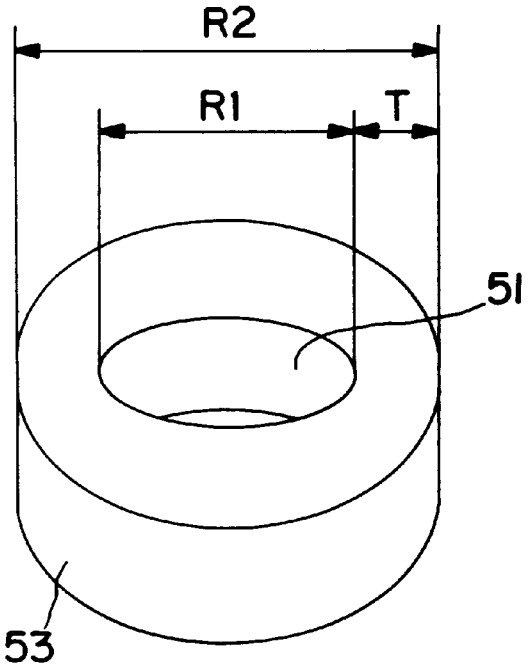
FIG. 3 is a perspective view of a typical permanent magnet used in the ignition coil of FIG. 1.
Figure 4:
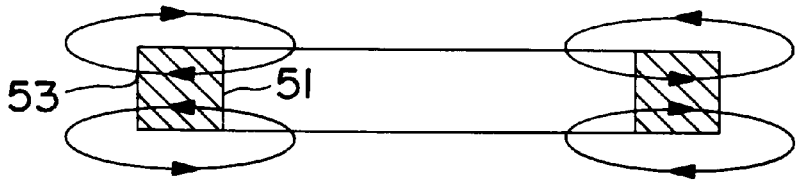
FIG. 4 is a cross-section of the magnet of FIG. 3.

As is more specifically shown in FIGS. 2 to 4, toroidal magnets 41, 43, 45, and 47 have inside perimeters 51 and outside perimeters 53. The latter has outer diameter R2 and the former has inner diameter R1. The difference between R2 and R1 is radial thickness T of the toroidal magnets. It has been found that, even if radial thickness T is one tenth of outer diameter R2 or less, cracking and chipping of the toroidal magnet during production is avoided or minimized. It is possible to have two different types of magnets 41, 43, 45, and 47, depending on the direction of the magnetic field generated by primary coil 25. Specifically, the direction of the magnetic field formed by the toroidal magnets is opposite to that generated by the primary coil. Thus, the choice of north or south polarity for inside perimeter 51 (and the opposite for outside perimeter 53) depends upon the direction of the primary coil magnetic field.

Successive toroidal magnets 41, 43, 45, and 47 are nested within one another and the entire assembly is inserted between magnetic core 23 and outer cylinder 33. Inside perimeter 51 of toroidal magnet 47 abuts the outer perimeter of magnetic core 23 and outside perimeter 53 of toroidal magnet 41 abuts the inside perimeter of outer cylinder 33.

Figure 5:
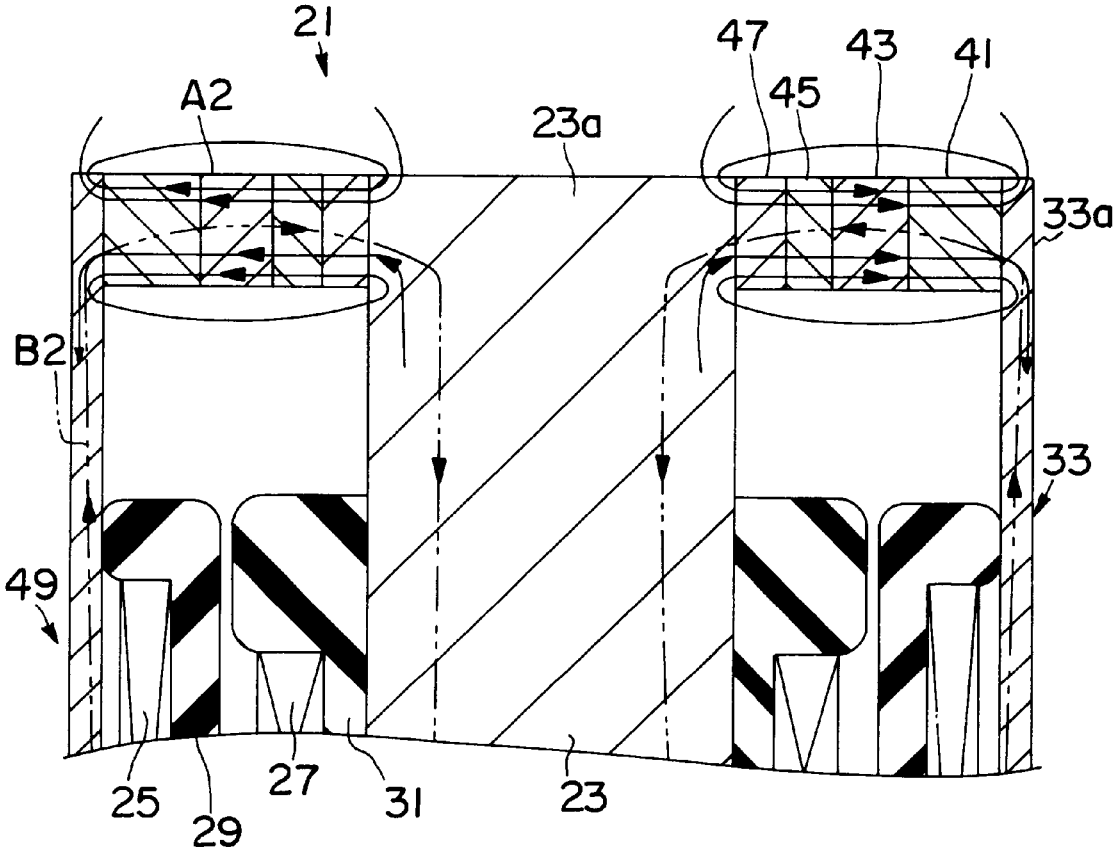
FIG. 5 is an enlarged cross-section of one end of the ignition coil of FIG. 1 showing the magnetic field formed by the magnet and primary coil.
Figure 6:
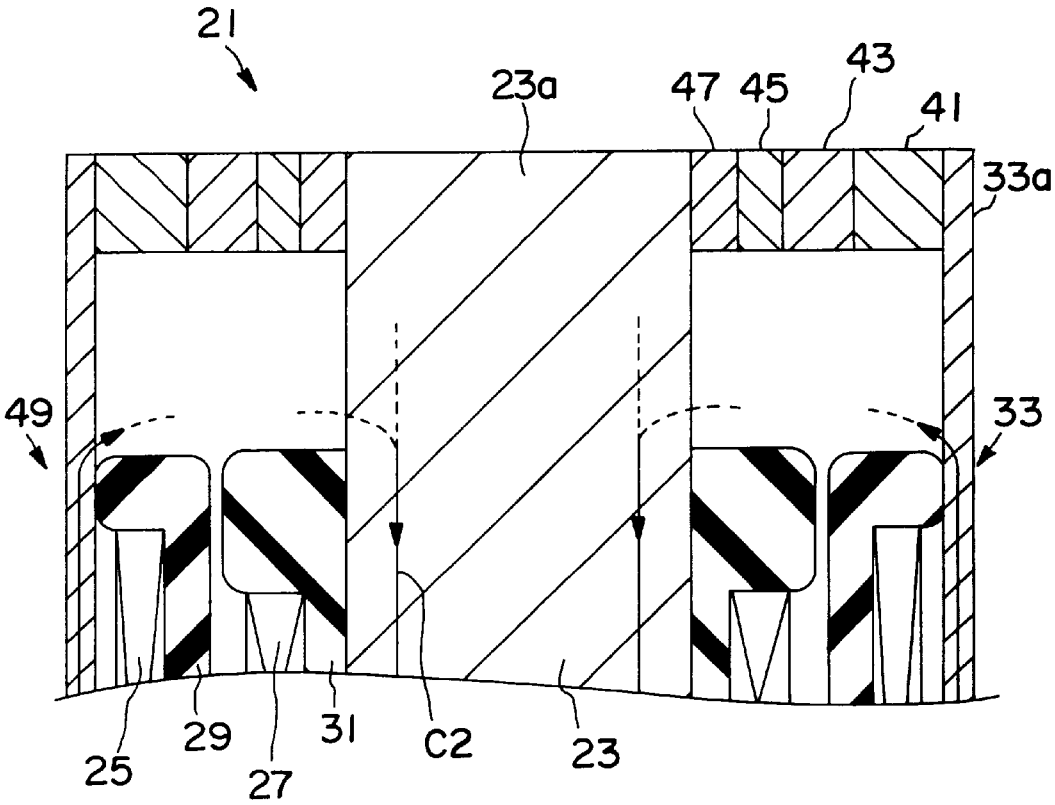
FIG. 6 is a view, similar to that of FIG. 5, showing the composite magnetic field.
Figure 7:
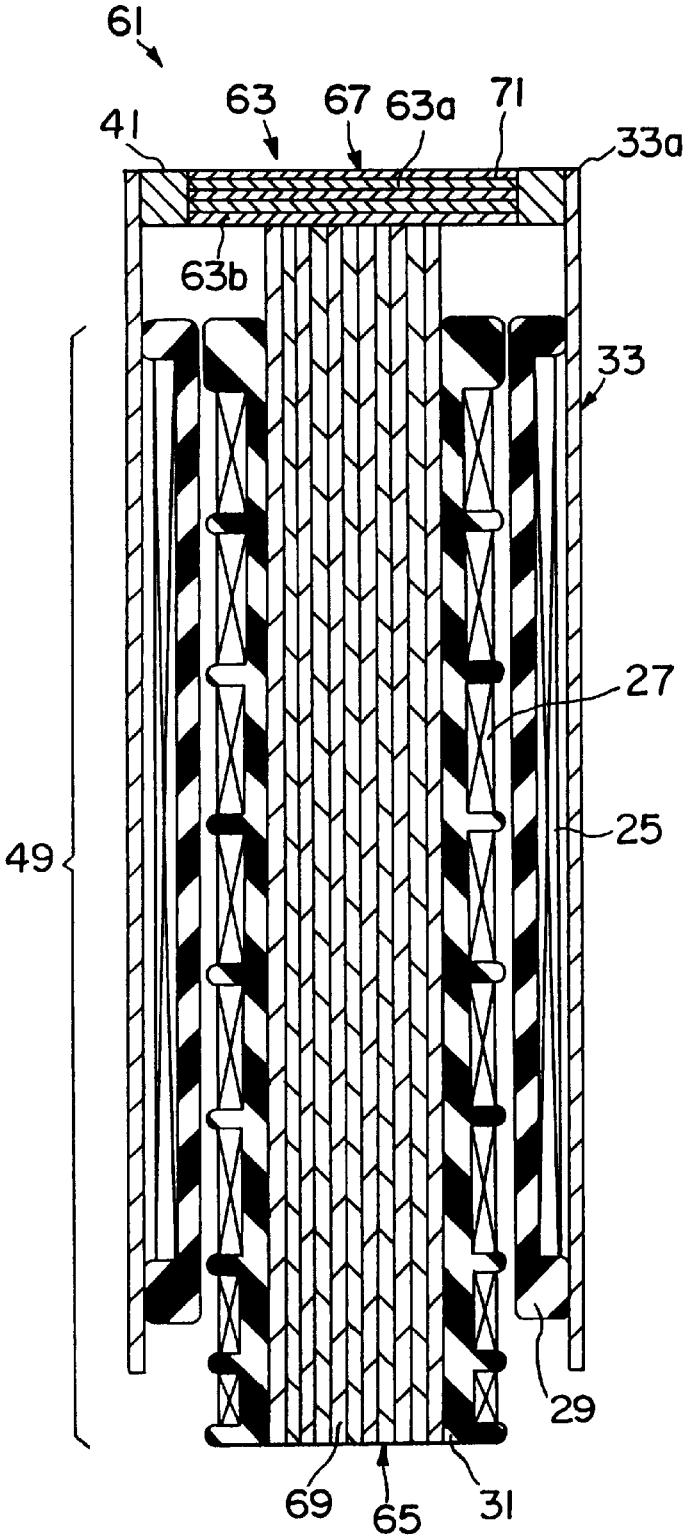
FIG. 7 is a view, similar to that of FIG. 1, of the second embodiment of the Invention.

As shown in FIGS. 5 and 6, primary magnetic field B2, generated by primary coil 25, is applied between magnetic core 23 and outer cylinder 33. Reverse biasing magnetic field A2, generated by toroidal magnets 41, 43, 45, and 47, is opposed to primary magnetic field B2 and serve to reduce it, thereby forming composite magnetic field C2. Thus, the provision of the plurality of toroidal magnets, each magnet having the same polar orientation as the others, strengthens reverse biasing magnetic field A2 so as to enable it to most effectively oppose primary magnetic field B1.

A second embodiment of the present Invention is shown in FIGS. 7 to 10. Ignition coil 61 is of generally the same configuration as ignition coil 21 shown in FIG. 1. However, magnetic core 63 comprises magnetic core unit 65 and flange 67. Magnetic core unit 65 and flange 67 are comprised of silicon steel alloy plates 69 and 71, respectively. The former are laminated in substantially the same manner as the first embodiment of the Invention. As to flange 67, silicon steel plates 71 are produced by stamping, but the diameter thereof is greater than the diameter of magnetic core unit 65. Plates 71 are stacked upon each other in abutting relationship. Toroidal magnet 41 is inserted between the inner wall of outer cylinder 33 and the outer edge 63*b* of flange 67.

Figure 8:
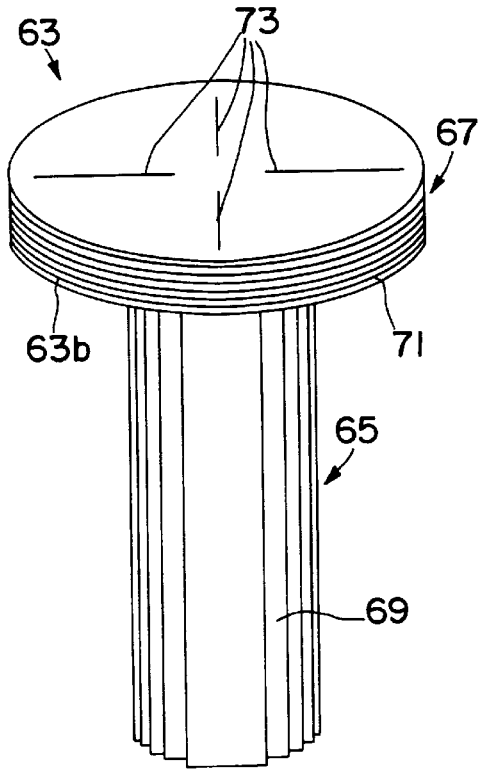
FIG. 8 is a perspective view of the magnetic core used in the ignition coil of FIG. 7.

One form of magnetic core 63 is shown in FIG. 8. Magnetic core unit 65 is made up of silicon steel plates 69. Flange 67, having edge 63*b*, is made up of a plurality of silicon steel plates 71. Slits 73 are radially and circumferentially disposed on flange 67 extending from points radially outward from the center of flange 67 to points radially inward from edge 63*b*. Slits 73 tend to reduce the amount of eddy current generated around the axis of magnetic core 63 when changes in magnetic field B1 generated by primary coil 25 occur.

Figure 9:
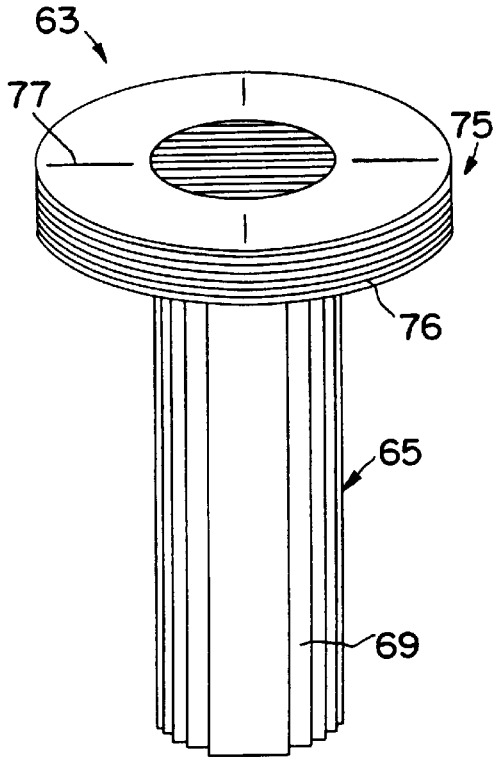
FIG. 9 is similar to FIG. 8 showing an alternative embodiment of the magnetic core of FIG. 8.

A further modification of magnetic core 63 is shown in FIG. 9. Flange 75 is comprised of toroidal stacked rings 76 of silicon steel alloy. After stacking, they fit snugly around the outer perimeter of magnetic core unit 65 to complete magnetic core 63. Slits 77 are provided for the same purpose as in the modification shown in FIG. 8.

Figure 10:
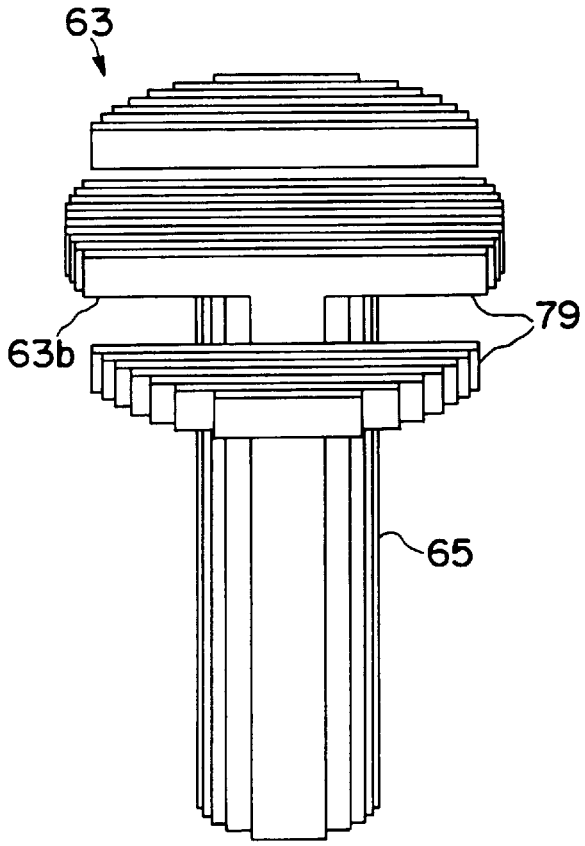
FIG. 10 is an exploded perspective view of a second alternative embodiment of the magnetic core of FIG. 8.
Figure 11:
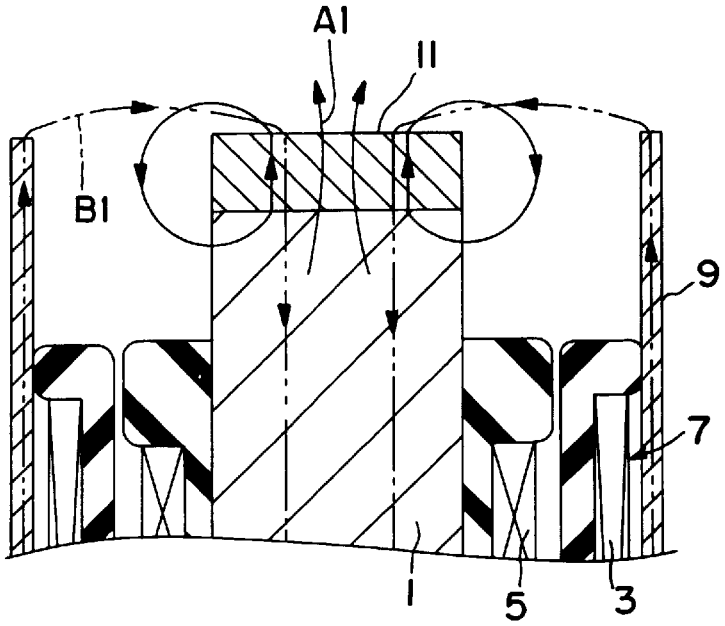
FIG. 11 PRIOR ART
FIG. 11 is a view, similar to that of FIG. 5, showing the magnetic fields of a prior art ignition coil.
Figure 12:
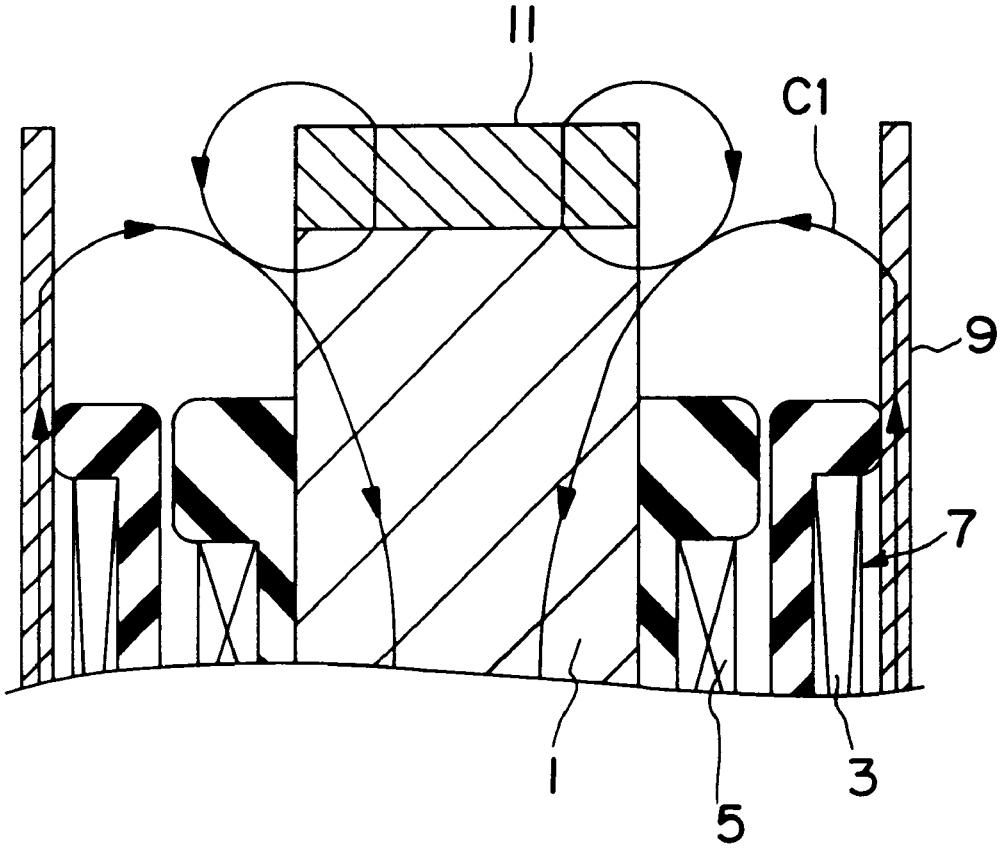
FIG. 12 PRIOR ART
FIG. 12 is a view, similar to that of FIG. 6, showing the composite magnetic field formed in the prior art device.

A further modification of magnetic core 63 is shown in FIG. 10. Here, both flange 63b and magnetic core unit 65 are comprised of a plurality of silicon steel alloy plates 79 extending in a direction parallel to the axis of magnetic core unit 65. This form of the Invention reduces the generation of eddy currents and no slits 73, 77 are required.

Although only certain embodiments and modifications of the present Invention have been expressly described, such changes as would be apparent to the person of ordinary skill may be made without departing from the scope or spirit thereof. Toroidal magnets 41, 43, 45, and 47 could be located at the opposite end of ignition coils 21 or 61, as well as being at both ends. These magnets are not limited to being toroidal, they can be rectangular or other shapes depending upon the nature of the space between outer cylinder 33 and magnetic core 23 or 63.

Although secondary coil 27 is shown and described as being inside primary coil 25, they could be arranged differently. It is within the scope of the present Invention that primary coil 25 and secondary coil 27 be located side-by-side along the axis of magnetic core 23 or 63. The magnetic members would be located near the end where the two coils are not adjacent.

The present Invention possesses many advantages. Because the magnetic field generated by the primary coil is between the magnetic core and the outer cylinder by way of the magnets, the reverse biasing field generated by the magnets is reliably opposed to the primary magnetic field, thus rendering the latter more effective.

The reverse biasing magnetic field is formed near the end of the transformer between the magnetic core and the outer cylinder, extending radially of the magnets. This radial magnetic field acts strongly against the primary magnetic field, thereby reducing the magnetic flux density in the magnetic core. This also reduces the residual magnetization in the magnetic core resulting from the primary magnetic field. Therefore, the ignition coil can be more compact, the diameter thereof can be reduced, and the energy retrieval efficiency is significantly improved.

The plurality of successive toroidal magnets is assembled one inside the other. This assembly is inserted between the magnetic core and the outer cylinder. No gaps are formed between the magnets or between the magnets and the magnetic core or the outer cylinder. As a result, the radial thickness of each magnet can be one tenth or less than the outer diameter without chipping or breakage occurring during production. As a result, the yield of magnets in production is improved and the cost of the ignition coil significantly reduced.

The use of laminated and/or stacked silicon steel provides a solution to the problem of machining this alloy. Thus, instead of attempting to machine, the elements are produced by stamping of thin plates which are pressed together to form the magnetic core unit and the flange. In this way, the superior magnetic properties of the silicon steel alloy are obtained without encountering the machining problems.

The inside and outside perimeters of the toroidal magnets have opposite polarities. In a single assembly, the location of the polarities is the same for all components thereof and the assembly is near the end of the transformer between the flange and the outer core. As a result, magnetic continuity between the magnetic core and the outer cylinder is achieved and the primary magnetic field extends between the magnetic core and the outer cylinder through the magnets. This provides efficient use of both the primary magnetic field and the reverse biasing magnetic field.

As to the reverse biasing magnetic field, it is generated radially by the magnets near the end of the transformer and extends between the magnetic core and the outer cylinder. This allows the reverse biasing magnetic field to be applied reliably against the primary magnetic field which is also generated between the magnetic core and the outer cylinder, thus reducing both the flux density within, and the residual magnetization by the primary magnetic field of, the magnetic core. This permits reduction in size of the ignition coil coupled with improved energy retrieval efficiency.

In the present Invention, a flange may be disposed on the magnetic core. In this construction, the inner and outer diameters of the magnets can be expanded more than in the arrangement found in Japanese OPI 3-154311 where the magnet is located within a ring-shaped core. Thus, the diameter of the flanges of the magnets can be increased, thereby enabling the provision of a reverse biasing magnetic field with adequate strength. The provision of radially extending slits in the flange reduces the eddy current generated around the axis within the flange which would otherwise result from changes in the primary magnetic field. Thus, energy loss is reduced and induced energy can be efficiently retrieved from the secondary coil.

Although only certain embodiments of the present Invention have been expressly disclosed, it is, nonetheless, to be broadly construed and not to be limited except by the character of the claims appended hereto.

What we claim is:

1. An ignition coil comprising a transformer surrounding a cylindrical magnetic core, said transformer including a primary coil, to which a DC potential is applied in bursts and which generates a primary magnetic field, and a secondary coil, which retrieves reduced electromotive force, and an outer cylinder surrounding said transformer;

a plurality of toroidal magnets, each with an inside perimeter and an outside perimeter having polarities opposite to each other, successive said toroidal magnets being nested inside one another and located adjacent at least one end of said transformer along an axis of said magnetic core, said toroidal magnets being between said magnetic core and said outer cylinder, whereby said toroidal magnets apply a counter magnetic field to said magnetic core and said outer cylinder, said counter magnetic field being opposite in direction to said primary magnetic field.

2. The ignition coil of claim 1 wherein said magnetic core comprises a plurality of laminated plates.

3. The ignition coil of claim 2 wherein said laminated plates extend along said axis of said magnetic core.

4. The ignition coil of claim 2 wherein said laminated plates are of silicon steel, and said laminated plates are stamped into predetermined shapes.

5. The ignition coil of claim 1 wherein said transformer abuts said magnetic core.

6. The ignition coil of claim 1 wherein said magnetic core extends axially beyond an end of said outer cylinder, said toroidal magnets being adjacent an end of said ignition coil remote therefrom.

7. An ignition coil comprising a transformer surrounding a cylindrical magnetic core, said magnetic core comprising a flange and a magnetic core unit, said transformer including a primary coil, to which a DC potential is applied in bursts and which generates a primary magnetic field, and a secondary coil, which retrieves reduced electromotive force, and an outer cylinder surrounding said transformer;

said flange projecting outwardly beyond an outer surface of said magnetic core unit adjacent at least one end thereof along an axis of said magnetic core unit, a toroidal magnet having an inside perimeter and an outside perimeter with polarities opposite to each other, said toroidal magnet being between an edge of said flange and an inner perimeter of said outer cylinder, whereby said toroidal magnet applies a counter magnetic field to said magnetic core and said outer cylinder, said counter magnetic field being opposite in direction to said primary magnetic field.

8. The ignition coil of claim 7 wherein said magnetic core unit extends axially of said ignition coil from said flange toward an end of said ignition coil remote from said flange.

9. The ignition coil of claim 8 wherein said magnetic core unit comprises a plurality of laminated plates abutting each other and extending axially of said magnetic core.

10. The ignition coil of claim 9 wherein said flange comprises a plurality of stacked plates abutting each other and extending outwardly beyond said outer surface.

11. The ignition coil of claim 10 wherein said stacked plates are of silicon steel stamped into shapes having diameters greater than that of said magnetic core unit, said laminated plates being of silicon steel stamped into predetermined shapes.

12. The ignition coil of claim 8 wherein said flange comprises a toroidal magnetic element having an inner diameter fitted to said outside diameter of said magnetic core unit.

13. The ignition coil of claim 12 wherein said toroidal magnetic element comprises a plurality of toroidal stacked rings abutting each other.

14. The ignition coil of claim 13 wherein said toroidal stacked rings are of silicon steel and are stamped into shapes having outer diameters larger than that of said magnetic core unit;

said magnetic core unit comprising a plurality of laminated plates extending along said axis of said magnetic core, said laminated plates being of silicon steel stamped into predetermined shapes.

15. The ignition coil of claim 14 wherein said toroidal stacked rings comprise at least one radial slit.

16. The ignition coil of claim 15 wherein there is a plurality of slits in said toroidal stacked rings extending along radii thereof.

17. The ignition coil of claim 11 wherein said stacked plates comprise at least one radial slit.

18. The ignition coil of claim 17 wherein there is a plurality of radial slits in said stacked plates.

19. The ignition coil of claim 9 wherein said flange comprises a plurality of laminated layers abutting each other, said laminated layers extending axially of said magnetic core.

* * * * *